US007210875B1

(12) United States Patent
Christle et al.

(10) Patent No.: US 7,210,875 B1
(45) Date of Patent: May 1, 2007

(54) ENTRAPMENT SNARE FOR THE TERMINATION OF VEHICLE PURSUITS

(76) Inventors: Ya-May Christle, P.O. Box 661384, Arcadia, CA (US) 91066-1384; Michael C. Goodman, P.O. Box 1011, Bellflower, CA (US) 90706

( * ) Notice: Subject to any disclaimer, the term of this patent is extended or adjusted under 35 U.S.C. 154(b) by 0 days.

(21) Appl. No.: 11/589,553

(22) Filed: Oct. 30, 2006

(51) Int. Cl.
*E01F 13/12* (2006.01)

(52) U.S. Cl. ..... 404/6; 404/72

(58) Field of Classification Search ..... 404/6, 404/72, 73
See application file for complete search history.

(56) References Cited

U.S. PATENT DOCUMENTS 4,619,231 A 10/1986 Stolar et al.
5,123,774 A * 6/1992 Dubiel ..... 404/6
5,293,527 A 3/1994 Sutton et al.
5,330,285 A 7/1994 Greves et al.
5,452,962 A 9/1995 Greves
5,498,102 A 3/1996 Bissell
5,503,059 A 4/1996 Pacholok
5,611,408 A * 3/1997 Abukhader ..... 180/287
5,815,822 A 9/1998 Iu
5,820,293 A 10/1998 Groen et al.
5,839,759 A 11/1998 Trigo
5,839,849 A 11/1998 Pacholok et al.
5,848,650 A 12/1998 Brady
5,921,704 A 7/1999 Pacholok et al.
5,933,075 A 8/1999 Ditson
6,072,248 A 6/2000 Muise et al.
6,124,805 A 9/2000 Gabbard
6,135,226 A 10/2000 Persichini et al.
6,155,745 A 12/2000 Groen et al.
6,176,519 B1 1/2001 Limingoja
6,206,608 B1 * 3/2001 Blevins ..... 404/6
6,220,781 B1 * 4/2001 Miller ..... 404/6
6,232,884 B1 5/2001 Gabbard
6,246,323 B1 6/2001 Fischbach
6,312,189 B1 11/2001 Marphetia
6,322,285 B1 * 11/2001 Ben ..... 404/6
6,371,000 B1 4/2002 Hutmacher et al.
6,392,531 B1 5/2002 Gabbard
6,409,420 B1 * 6/2002 Horton et al. ..... 404/6
6,411,217 B1 6/2002 Gabbard
6,470,260 B2 10/2002 Martens et al.
6,505,101 B1 1/2003 Brill
6,527,475 B1 * 3/2003 Lowrie ..... 404/6
6,614,362 B2 9/2003 Siegel
6,623,205 B1 * 9/2003 Ramirez ..... 404/6
6,650,283 B2 11/2003 Brydges et al.
6,715,395 B1 4/2004 Heibel (Continued)

*Primary Examiner*—Gary S. Hartmann

(57) ABSTRACT

An entrapment snare, consisting of two small but heavy weights connected by a flexible cable covered with spikes, is designed to be launched from a pursuing law enforcement vehicle at one of the rear tires of a fleeing vehicle. One heavy weight is attached to each end of the flexible cable. The weights are forcefully projected, at ground level, in a forward direction at one of the rear tires of the fleeing vehicle such that the weights bracket the tire. Initially, the two projectile weights have forward linear momentum and the cable connecting them is slack. The middle of the cable hits the target tire at or near where the rubber meets the road and the cable goes into tension. Very quickly, the two ends of the cable attached to the projectile weights pull tightly into place in front of the target tire.

1 Claim, 12 Drawing Sheets

U.S. PATENT DOCUMENTS 6,723,225 B2 4/2004 Scheps
6,758,628 B1 * 7/2004 Curry, Jr. ..... 404/6
6,897,762 B2 5/2005 Howells
6,952,646 B2 10/2005 Chang
6,994,488 B2 2/2006 Crowley, Sr.
7,011,164 B1 3/2006 Breazeale
7,011,470 B1 3/2006 Breazeale et al.
7,015,792 B2 3/2006 Lessard et al.
7,037,032 B1 5/2006 Marphetia
7,056,054 B1 * 6/2006 Keith et al. ..... 404/6
7,121,760 B1 * 10/2006 Curry, Jr. ..... 404/6
2005/0244223 A1 11/2005 Shackelford et al.

* cited by examiner

ENTRAPMENT SNARE FOR THE TERMINATION OF VEHICLE PURSUITS

BACKGROUND OF THE PRESENT INVENTION

1. Field of the Invention

This invention relates to vehicle disabling devices used by law enforcement vehicles to stop fleeing suspect vehicles. More particularly, this invention relates to a vehicle-disabling device that can be projected from a police vehicle toward a rear tire of a fleeing vehicle, said device flattening the tire of the fleeing vehicle.

2. Description of the Related Art

One of the most difficult problems currently facing law enforcement is the issue of high-speed vehicle pursuits. Once a police vehicle activates its forward facing red light and sounds its siren, any vehicle in front of the police vehicle is required by law to pull over to the right side of the road and stop. When a suspect vehicle fails to do this, police are faced with the choice of going into pursuit or letting the suspect go. Neither alternative is a good one. High-speed pursuits injure and kill many innocent people every year and some police departments no longer chase fleeing vehicles. The problem with a no-pursuit policy is that criminals become more brazen in their activities, confident that the police will not chase them if they are in a motor vehicle. Many devices have been developed to stop a fleeing vehicle but all prior designs have limitations, which the present invention overcomes. To better understand the advantages of the present invention, the prior art will be described.

The pursuit intervention technique is a method of trying to throw the suspect vehicle out of control. The police vehicle tries to make contact with the fleeing vehicle, generally pushing the left rear side of the suspect with the right front side of the police vehicle. Because the front of a vehicle is usually heavier than the back because of the weight of the engine, it is sometimes possible to shove the rear of a fleeing vehicle sideways, causing it to lose control and go into a spin while the police vehicle stays in control. This technique is quite dangerous, involving vehicle-to-vehicle contact at high speeds. In the process of pushing the suspect, the police vehicle could also go out of control and will experience collision damage during the aggressive contact. Thus, police vehicle, suspect vehicle or both could go out of control, endangering everybody on the road. Some prior art patents show big hooks or grappling fixtures attached to the front of the police vehicle to link the police vehicle to the suspect vehicle. This causes the police vehicle to become vulnerable to the suspect's actions, which could force both vehicles into a crash. Another weakness of the pursuit intervention technique is that it does not actually disable the fleeing vehicle but merely throws it into a spin. It is out of control while it is spinning but, if it does not experience a disabling crash, after it stops spinning the driver could resume his attempts to evade capture.

The most common technique used by law enforcement is to lay down spike strips across the road, positioned so that the suspect vehicle will drive over them. Various types of spikes are available to either rapidly or slowly deflate a tire. In order for this technique to work, law enforcement must correctly anticipate where the suspect vehicle will go, get there first and lay out the spike strips in front of it. On a multi-lane road, unless the spikes are laid down across all lanes, the fleeing vehicle can swerve to avoid the strips. Also, any other vehicle coming along could run over the strips. Thus, spike strips can only be used when officers are at a position where the suspect is going to pass by and no other vehicles are going to pass by. Spike strips deflate a vehicle's front tires because those tires are the first to roll over the spike strips. Thus, there is the possibility that a suspect vehicle could lose control and crash into another vehicle or a pedestrian.

In addition to spike strips, there are other ways to put barriers across a road such as parking heavy trucks end to end across all lanes or the eastern European (behind the iron curtain) technique of pushing big concrete blocks on rollers out to barricade the road. Similar to spike strips, officers must anticipate where the suspect will go and any other traffic that would normally pass through must be diverted or stopped. If the suspect vehicle is going too fast to stop before hitting the barricades, the suspect could be killed, making this a potentially deadly use of force.

A review of the prior art shows several patents wherein a bundle of two or more spike strips are propelled lengthwise like an arrow between the two rear wheels of a fleeing vehicle. With means to open the bundle, each spike strip rotates ninety degrees to create a spike strip barrier parallel to the fleeing vehicle's rear axle. If the bundle opens in front of the rear tires, said rear tires will drive over said spike strips. If such a device deploys late, it will blow out the front tires. If it rotates during its travel, it might deploy perpendicular to the tire axles and do nothing at all. If such a device deploys early, it will bounce against the back of the rear tires, probably getting kicked away. If the force of impact into the back of the tires is strong enough that the spikes take hold, the whole assembly will rotate up with the rotation of the tires. The center portion of said assembly will then be slammed into the bottom of the gas tank. Experiments have shown that when both tires are attacked at the same time with devices that are linked together, the connecting cable will slam into the bottom of the fleeing vehicle's gas tank.

The prior art shows examples where a strong electromagnetic pulse is to be used to disable a vehicle. This would require a very strong discharge of energy such as occurs inside a microwave oven or during a lightning strike. Such a technique would only work on cars with electronic ignition, the pulse destroying at least some electronic components. An energy level high enough to do this would threaten the health of anyone inside or near the targeted vehicle. It would kill someone with a pacemaker, even if they were in another vehicle nearby or on a sidewalk. Such an energy discharge could possibly cause a vehicle gas tank to explode (on the suspect vehicle or any other vehicle nearby).

Another prior art design involves firing projectiles such as bullets at tires. Tires are small, hard targets to hit, and bullets that miss could hit an innocent bystander or a vehicle gas tank.

The most common prior art design in the patent archives shows various ways of using electronic remote control to cause a fleeing vehicle to stop. Radio devices send a signal from a police vehicle to a suspect vehicle, which then cooperates with the police by shutting down the suspect vehicle's engine. There is also a design wherein an encoded laser in a police vehicle is shined on a sensor on the back of the suspect vehicle. The fleeing vehicle recognizes the signal as being a legitimate law enforcement command and electronics on-board the suspect vehicle shut down the engine. One problem with any of these designs is that they will not work on a vehicle that is not equipped with the appropriate electronic devices. Another problem is that criminals could disable such devices. In the laser halting system, a piece of black masking tape covering the optical sensor on the back of the suspect vehicle would render that system inoperative.

Some prior art designs show the use of combustion-suppressing gas to suffocate the engine of a fleeing vehicle. To work, this design would require a large quantity of gas. A small amount of gas might cause the engine to stall momentarily but it would restart after the car had rolled out of the gassed area. Any gas that will asphyxiate an air-breathing engine will asphyxiate an air-breathing human being. If enough gas can be released to make this technique work, anyone within the affected area (drivers, passengers or pedestrians) will face a lethal threat. If there were a wind present, the gas might be blown away from the fleeing vehicle and into some other area such as a school playground.

Other designs have shown the technique of projecting a radio beacon or transponder from the police vehicle to the suspect vehicle. This radio locating transmitter would have means that enable it to attach to the fleeing vehicle. It would then broadcast a signal (possibly including Global Positioning System data) to identify its location. This technique is similar to the way marine biologists tag a whale or shark and then track its movements. The technique does nothing to control or stop the fleeing vehicle.

Thus, it can be seen that there is a long-felt but unfilled need for a device which will enable officers in a police vehicle to quickly and safely stop any vehicle in front of them which fails to pull over on command. The present invention satisfies this need.

SUMMARY OF THE PRESENT INVENTION

Experiments have shown that if two weights are attached to the ends of a cable and if both weights are simultaneously flung in a manner that brackets an obstacle smaller than the length of the cable (that can not be easily moved), the kinetic energy of the weights will cause the cable to wrap around the obstacle. The object of the present invention is to use this principle to provide a mechanism for disabling a moving vehicle by attacking one of the fleeing vehicle's rear tires from behind, said mechanism being launched from a pursuing vehicle.

The present invention introduces the concept of the spike cable. Where prior art has shown how spike strips can be laid down in front of a moving vehicle which then runs over the spikes, a flexible spike cable can be flung at a tire from behind, wrapping around the target tire. Two projectile weights are connected by a cable which is covered with hooked barbs such as fishing tackle. The weights are launched from a pursuing vehicle at a fleeing vehicle. The weights are forcefully projected horizontally (at ground level) in a forward direction at one of the rear tires of the fleeing vehicle such that the weights bracket the tire, one weight going to the left of the targeted tire and the other weight going to the right of the targeted tire. The main goal of the design is to get spikes from behind the tire to in front of the tire so that the targeted tire will then drive over the spikes.

After launch, the two projectile weights have forward linear momentum and the cable connecting them is slack. The middle of the cable hits the target tire at or near where the rubber meets the road and the cable goes into tension. The motion of two essentially independent bodies (the projectile weights) becomes a dynamic system of two bodies in constrained motion. The tension in the cable acts perpendicular to the direction of motion of each of the projectile weights. The principle of the conservation of energy (in this case, the conservation of kinetic energy) causes the linear momentum of the projectile weights to be converted into angular momentum. The relative motion of the two projectile weights was parallel to each other and is now toward each other as they wrap the connecting cable around the tire.

As the weights rotate toward each other, the radius of rotation decreases because the free ends of the cable are getting shorter as the cable wraps around the tire. As the radius of rotation decreases, conservation of angular momentum causes the speed of rotation of the two projectile weights to increase. Thus, very quickly, the two ends of the cable attached to the projectile weights will pull tightly into place in front of the target tire.

Thus, the goal of getting some sharp spikes from behind the tire to in front of the tire has been accomplished. If the tire is in forward motion, it will roll over those parts of the spike cable that cross around in front of the tire. If there are spikes, hooked barbs or fishing tackle attached at closely spaced intervals to the cable, the target tire will run over some of those sharp objects. The design can be such that the tire is immediately punctured but an alternative design calls for embedding smaller spikes in the tire, securing the cable to the tire. If there is a mesh arrangement of other spike cables (a cable ladder) attached to, and trailing behind, the forward most spike cable, that arrangement will be drawn into, and wrap around the target tire like a snow chain. Various types of spikes or barbs can deflate the tire rapidly or slowly.

Another object of the present invention is to provide an arresting cable mechanism whereby heavier arresting cables trail from each side of a mesh (cable ladder), which trails behind the forward most spike cable. Once the forward most spike cable and the following mesh of spike cables have embedded themselves around the tire like a snow chain, the arresting cables will initially trail behind, on the left and right sides of the target tire. As the tire rotates, (there would be two arresting cables for projectile symmetry but also so that the mechanism can be shot at either the left or right rear tire of the fleeing vehicle) one of the arresting cables will wrap around the axle of the vehicle. Thus, the vehicle will be disabled because there will be a heavy cable wrapped around the rear axle linked to a mesh of spike cables wrapped around the targeted tire. This method will stop a vehicle from running along on flattened tires.

All versions of the present invention attack a rear tire only, leaving the front tires free to continue their normal steering function. Thus, the chance of the suspect vehicle losing control before being brought to a stop is minimized.

These and other features and advantages of the present invention will become apparent from the following detailed description, the accompanying drawings, and the appended claims.

DETAILED DESCRIPTION OF THE PREFERRED EMBODIMENT

Figure 1:
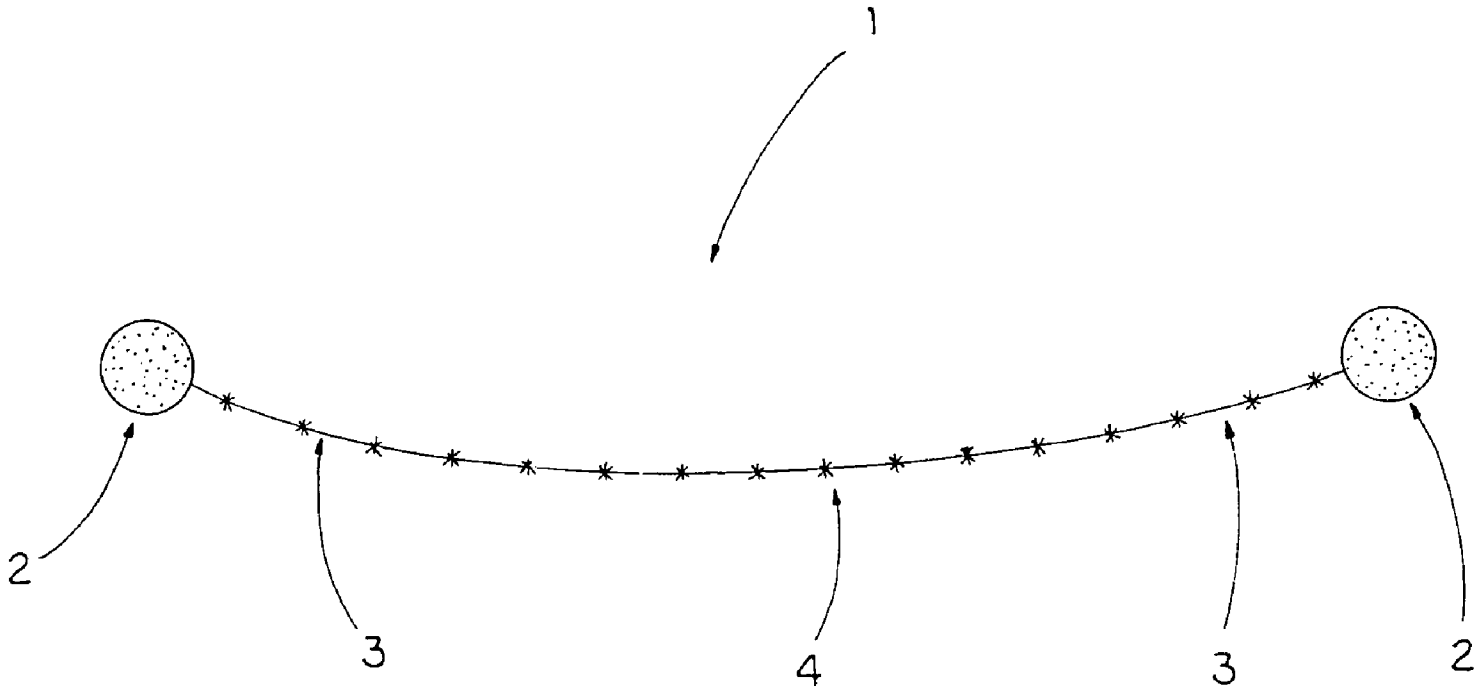
FIG. 1 is a perspective view of an entrapment snare used to safely terminate vehicle pursuits.

FIG. 1 shows an entrapment snare 1 consisting of a flexible cable 3 with projectile weights 2 attached to each end of cable 3. Hooked barbs 4 such as fishing tackle are attached to cable 3 at intervals along said cable.

Figure 2:
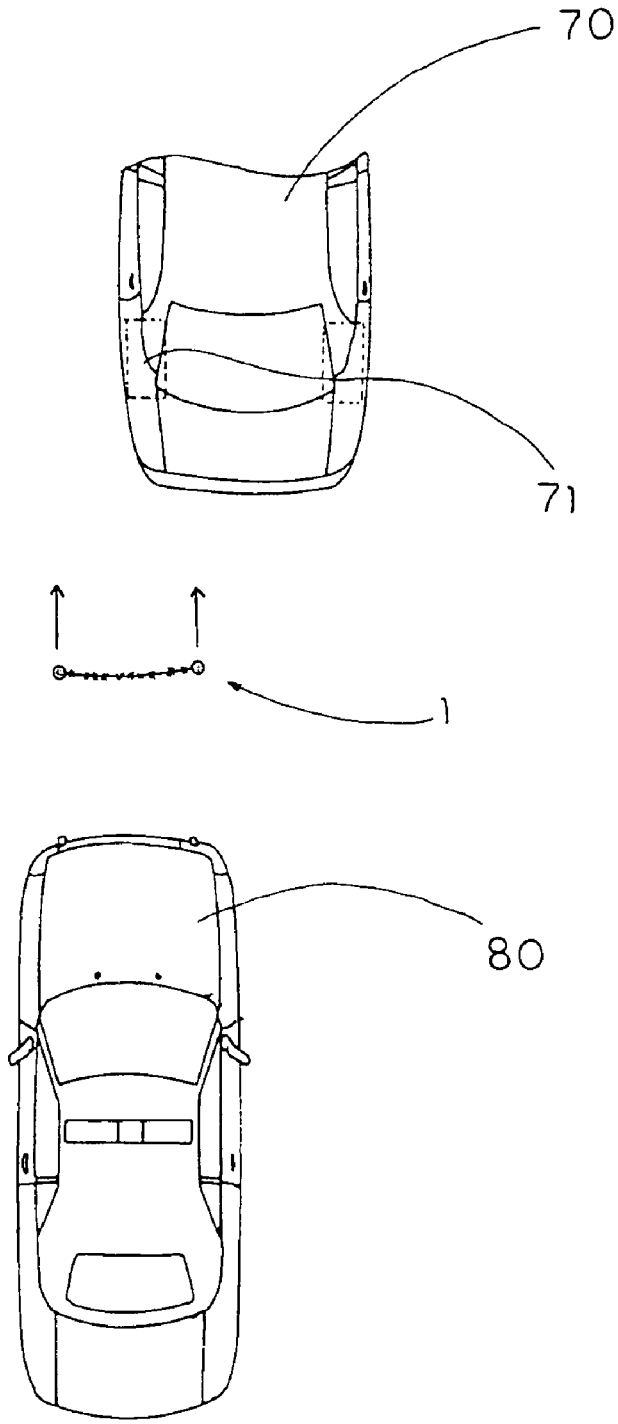
FIG. 2 is a top plan view of the entrapment snare in transit from the pursuing police vehicle to the fleeing vehicle after it has been launched from the police vehicle.
Figure 3:
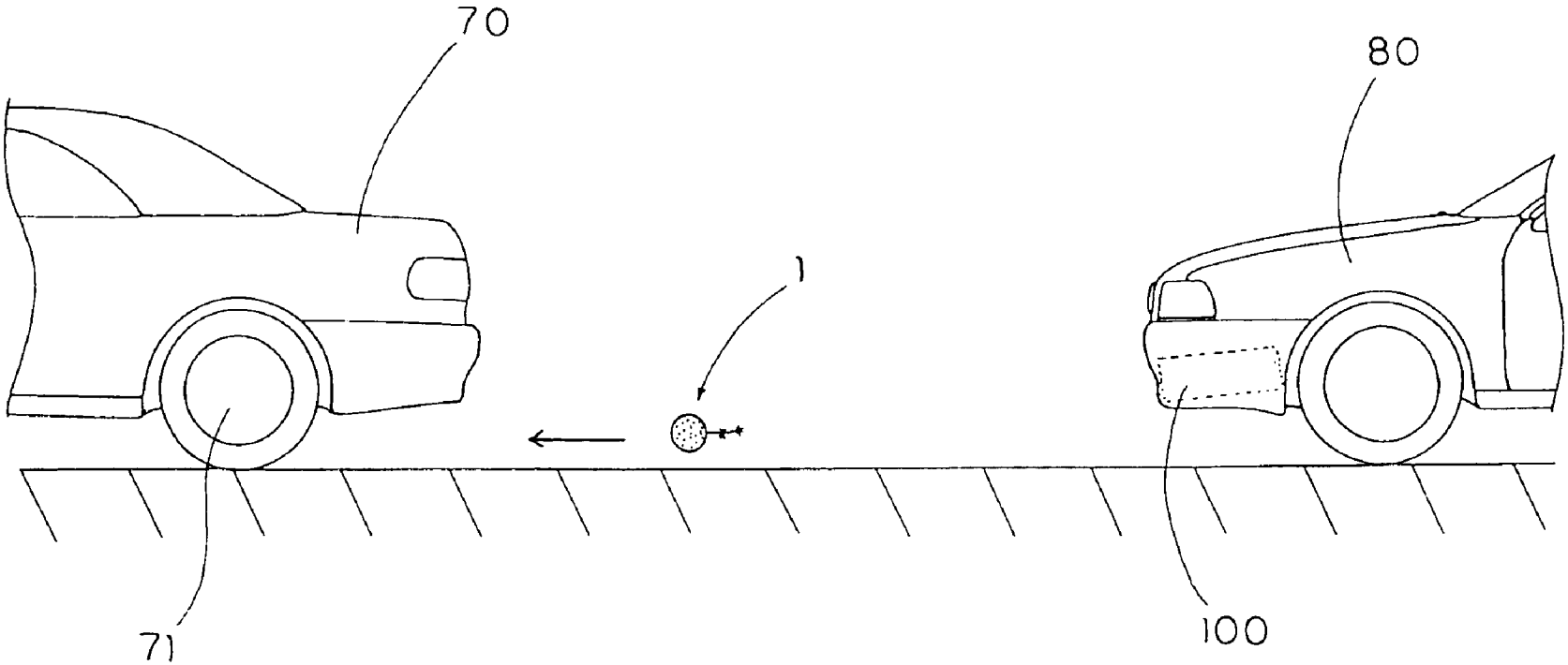
FIG. 3 is a side elevational view of the entrapment snare in transit from the police vehicle to the fleeing vehicle, illustrating that the snare is traveling very close to the ground surface.

FIG. 2 shows the entrapment snare 1 after it has been launched from a police vehicle 80 toward a fleeing suspect vehicle 70. In FIG. 2, the left rear tire 71 of fleeing suspect vehicle 70 has been targeted by the police vehicle 80. FIG. 3 shows the entrapment snare 1 after it has been launched by projection means 100 from the police vehicle 80. As can be seen, entrapment snare 1 is traveling on or very near the surface of the ground as it heads toward the targeted tire 71 of the fleeing vehicle 70. The projectile weights 2 (shown in FIG. 1) have been forcefully projected horizontally (at ground level) in a forward direction at one of the rear tires 71 of the fleeing vehicle 70 such that the weights 2 bracket the tire 71, one weight 2 going to the left of the targeted tire 71 and the other weight 2 going to the right of the targeted tire 71. There are many different ways of providing projection means 100 to propel entrapment snare 1. Such means include (but are not limited to) compressed gas discharges, gun powder or other explosive ordinance discharges, metal spring launchers and rubber band (archery) launch mechanisms. When it is stated that weights are forcefully projected, it is meant that they are given as much forward momentum as is practical given the projection means 100 employed in a particular design.

Figure 4:
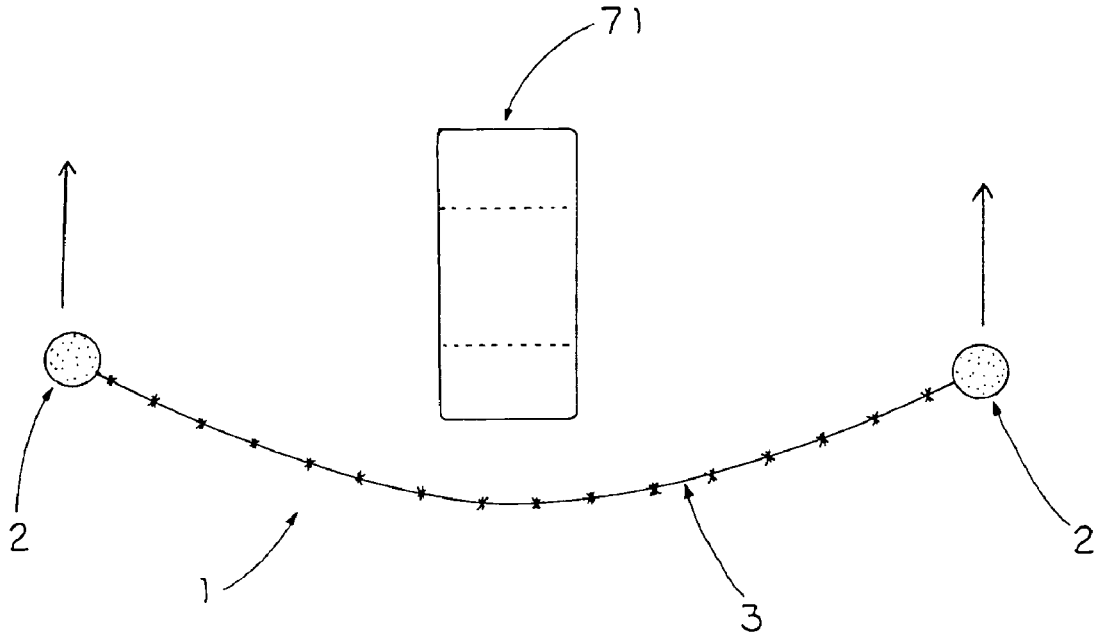
FIG. 4 is a top plan view of the entrapment snare approaching the targeted tire of the fleeing vehicle, illustrating that the projectile weights are traveling parallel to each other and that the spike cable is in slack.
Figure 5:
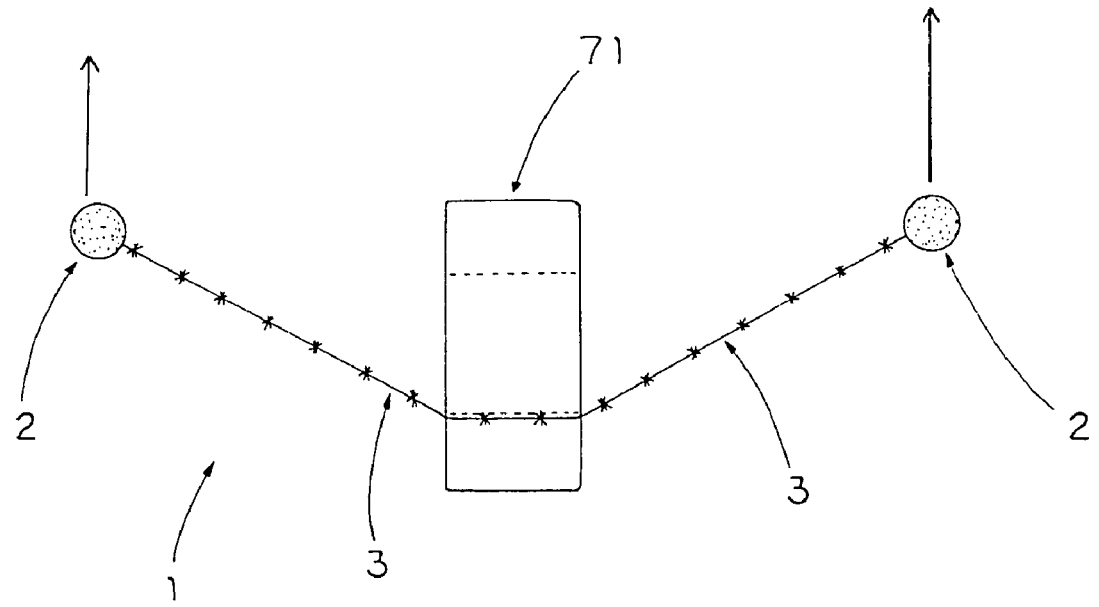
FIG. 5 is a top plan view of the entrapment snare making contact with the targeted tire at or near where the rubber meets the road, illustrating that the spike cable is going into tension.
Figure 6:
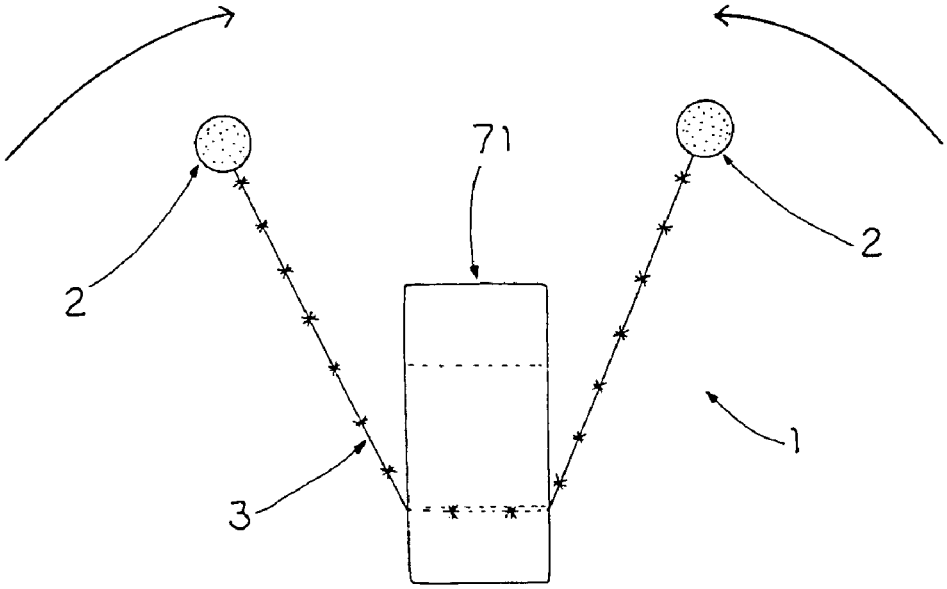
FIG. 6 is a top plan view of the entrapment snare, illustrating that tension in the spike cable has caused the forward linear momentum of the projectile weights to be converted into angular momentum, causing the weights to rotate toward each other.
Figure 7:
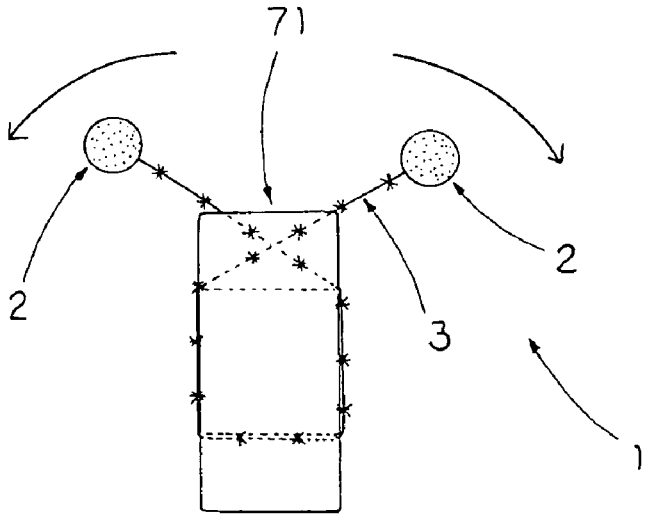
FIG. 7 is a top plan view of the entrapment snare, illustrating how the projectile weights cross around in front of the target tire.
Figure 8:
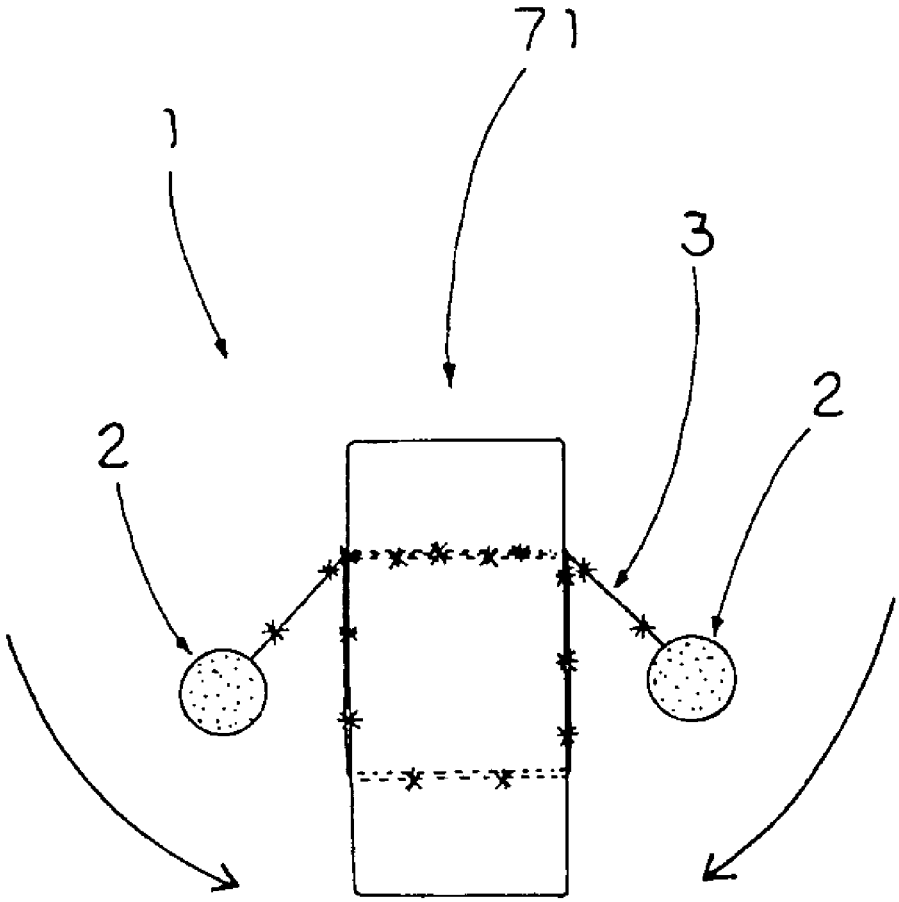
FIG. 8 is a top plan view of the entrapment snare, illustrating how the motion of the projectile weights has caused the two ends of the spike cable to be pulled tightly down in front of the target tire.

FIG. 4 shows entrapment snare 1 approaching target tire 71. The projectile weights 2 are traveling parallel to each other and the cable 3 is in slack. FIG. 5 shows that the middle of the cable 3 has made contact with the tire 71 at or near where the tire contacts the road surface. The forward motion of the projectile weights 2 is causing the cable 3 to go into tension. FIG. 6 shows that the tension in the cable 3 has caused the forward linear momentum of the projectile weights 2 to be converted into angular momentum so that the weights 2 rotate toward each other. This is because the tension in the cable 3 acts perpendicular to the direction of motion of the projectile weights 2. FIG. 7 shows how the projectile weights 2 continue to rotate around in front of the target tire 71, crossing each other. FIG. 8 shows how the motion of the projectile weights 2 has caused the two ends of the spike cable 3 to be pulled tightly down in front of the target tire 71. If the tire 71 is in forward motion, it will then roll over some of the hooked barbs 4 (shown in FIG. 1) attached to the cable 3.

Figure 9:
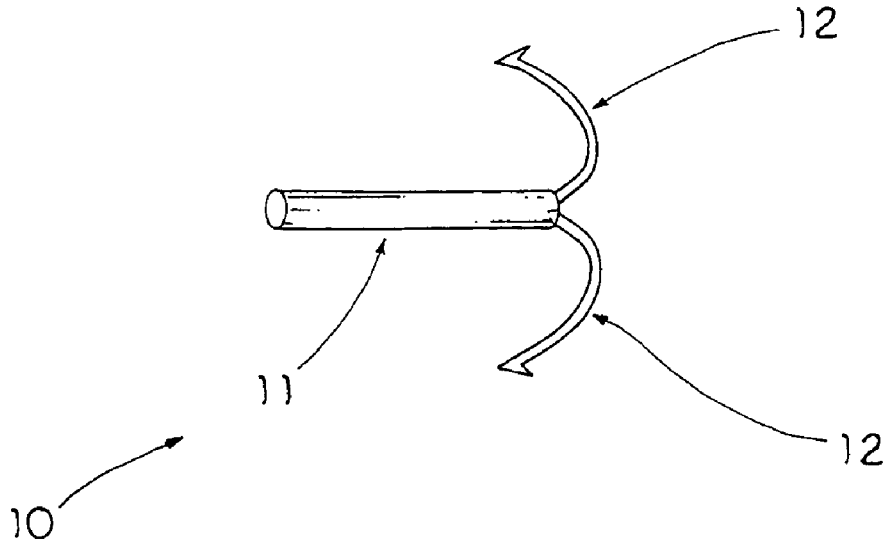
FIG. 9 is a perspective view of a fishing tackle to be used in a preferred embodiment of the present invention.
Figure 10:
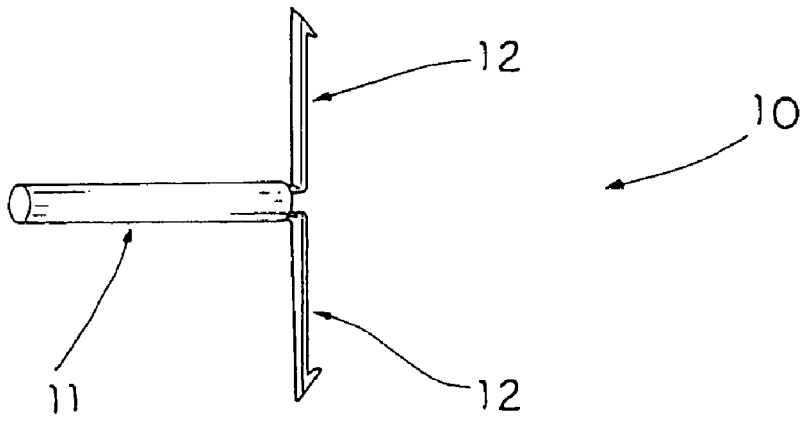
FIG. 10 is perspective view of a fishing tackle to be used in a preferred embodiment of the present invention, with the hooked barbs bent to be perpendicular to the shaft.

FIG. 9 shows a fishing tackle 10 with a central shaft 11 and hooked barbs 12. FIG. 10 shows the fishing tackle 10 of FIG. 9 with the hooked barbs 12 bent to be perpendicular to the central shaft 11. The fishing tackle 10 of FIG. 10 could be attached to the flexible cable 3 of the entrapment snare 1 of FIG. 1 to be a hooked barb 4 used to puncture a targeted tire 71 (shown in FIG. 2) of a fleeing vehicle 70.

Figure 11:
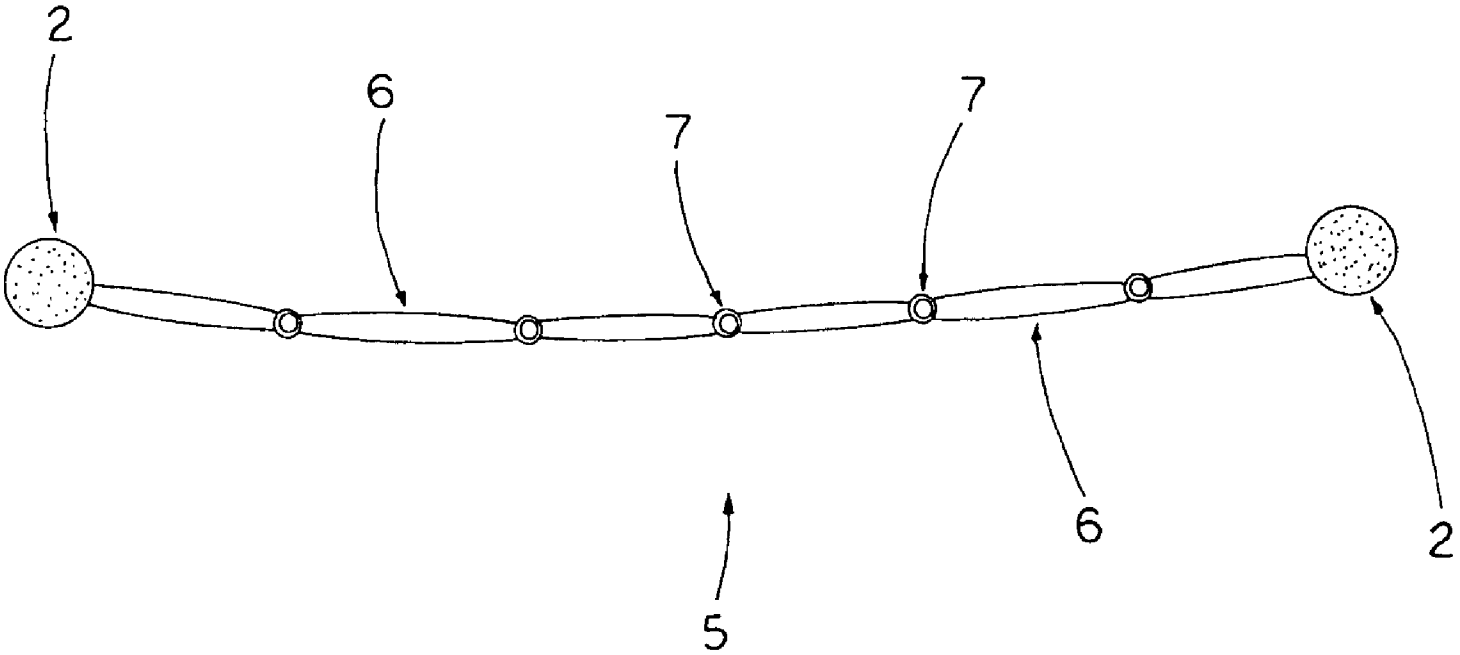
FIG. 11 is a perspective view of an attach and attack mechanism according to a preferred embodiment of the present invention.

FIG. 11 shows an attach and attack mechanism 5 intended to function similarly to the entrapment snare 1 of FIG. 1. Both embodiments use projectile weights 2 but the flexible cable 3 of FIG. 1 has been replaced with a flexible chain of rigid segments 6 pivotally linked together at joints 7. The rigid segments 6 could be miniature spike strips provided with means to puncture a tire.

Figure 12:
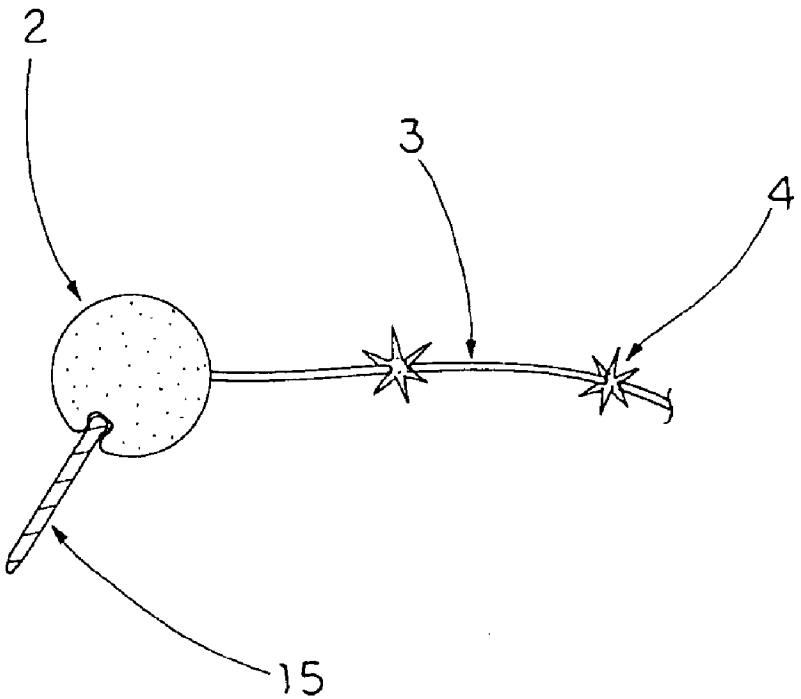
FIG. 12 is a perspective view of one end of an entrapment snare wherein a spear has been detachably fitted into a projectile weight.

FIG. 12 shows one end of an entrapment snare wherein a spear 15 has been detachably fitted into a projectile weight 2. For prototype testing purposes, two spear guns firing simultaneously and in parallel launched the projectile weights 2. When the entrapment snare 1 was in a position similar to that shown in FIG. 7. the spears 15 detached from the projectile weights 2, flying forward and away from the targeted tire 71 (shown in FIG. 2). This projection technique was used for experimental validation of the basic design. It is anticipated that the final, production version of the invention will function without having to discard any components that may remain on the roadway as a potential hazard.

Figure 13:
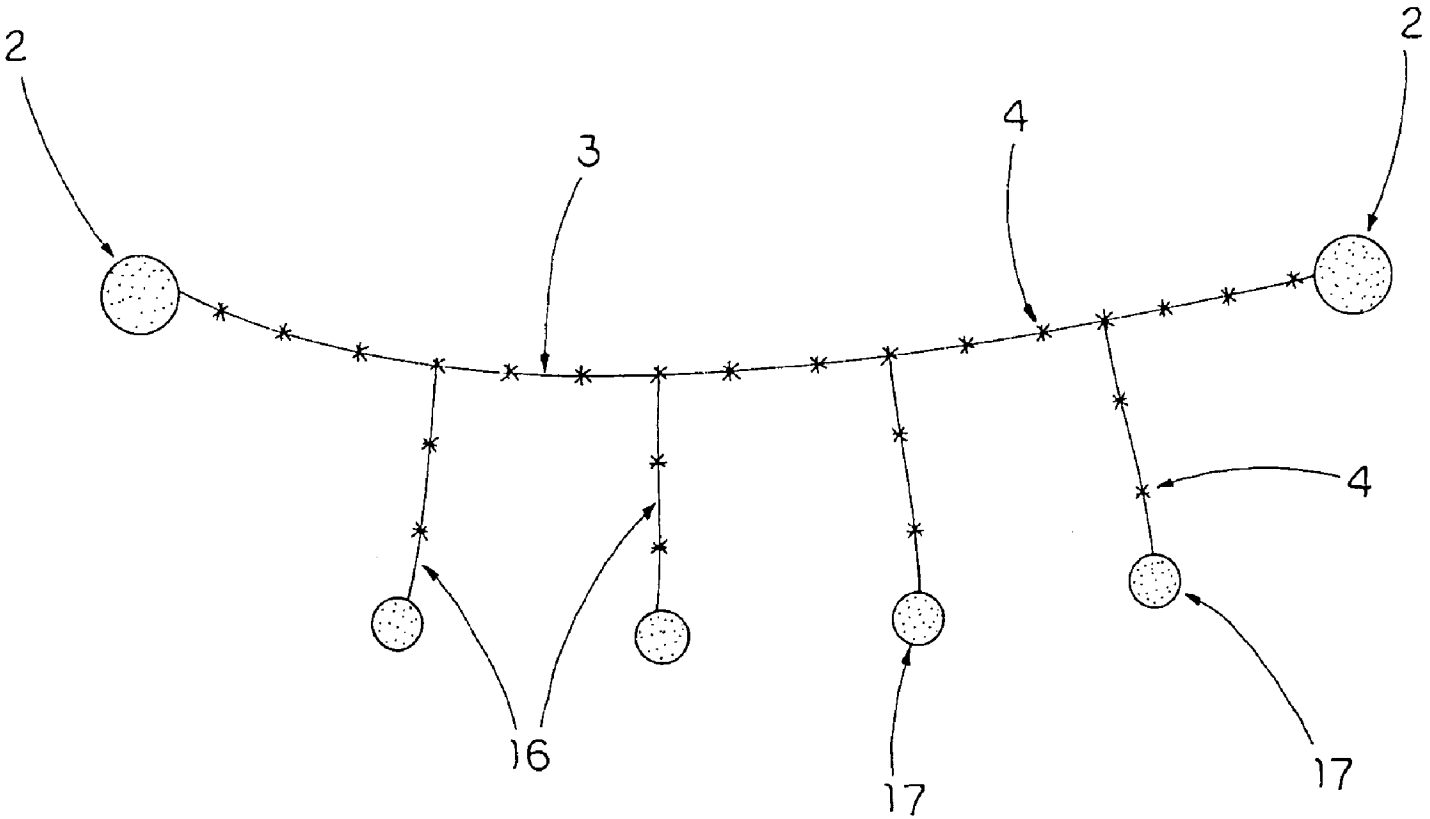
FIG. 13 is a top plan view of an entrapment snare wherein multiple short cables are attached to the spike cable at intervals along the cable, illustrating that the short cables trail behind the main cable.

FIG. 13 shows an entrapment snare wherein multiple short cables 16 are attached to the spike cable 3 at intervals along the cable, illustrating that the short cables 16 trail behind the main cable 3. Stabilizing weights 17 are attached to the ends of the short cables 16. This embodiment provides the equivalent of a collection of spike cables of different lengths all bunched together and hurled at the fleeing vehicle's tire 71 (shown in FIG. 2) at the same time. This arrangement will cause the target tire 71 to become entangled more rapidly and more tenaciously than if there were just one spike cable 3. For example, if the main cable 3 is not centered on the target tire 71, one end will take longer to swing around in front of said tire 71 than the other end will. With multiple short trailing cables 16, one or more of the shorter cables 16 will wrap around the tire 71 before the primary spike cable 3 has snared the tire. Thus, the snare will entangle the target quicker and (with more spikes being brought around to the front of the target tire) more tenaciously.

Figure 14:
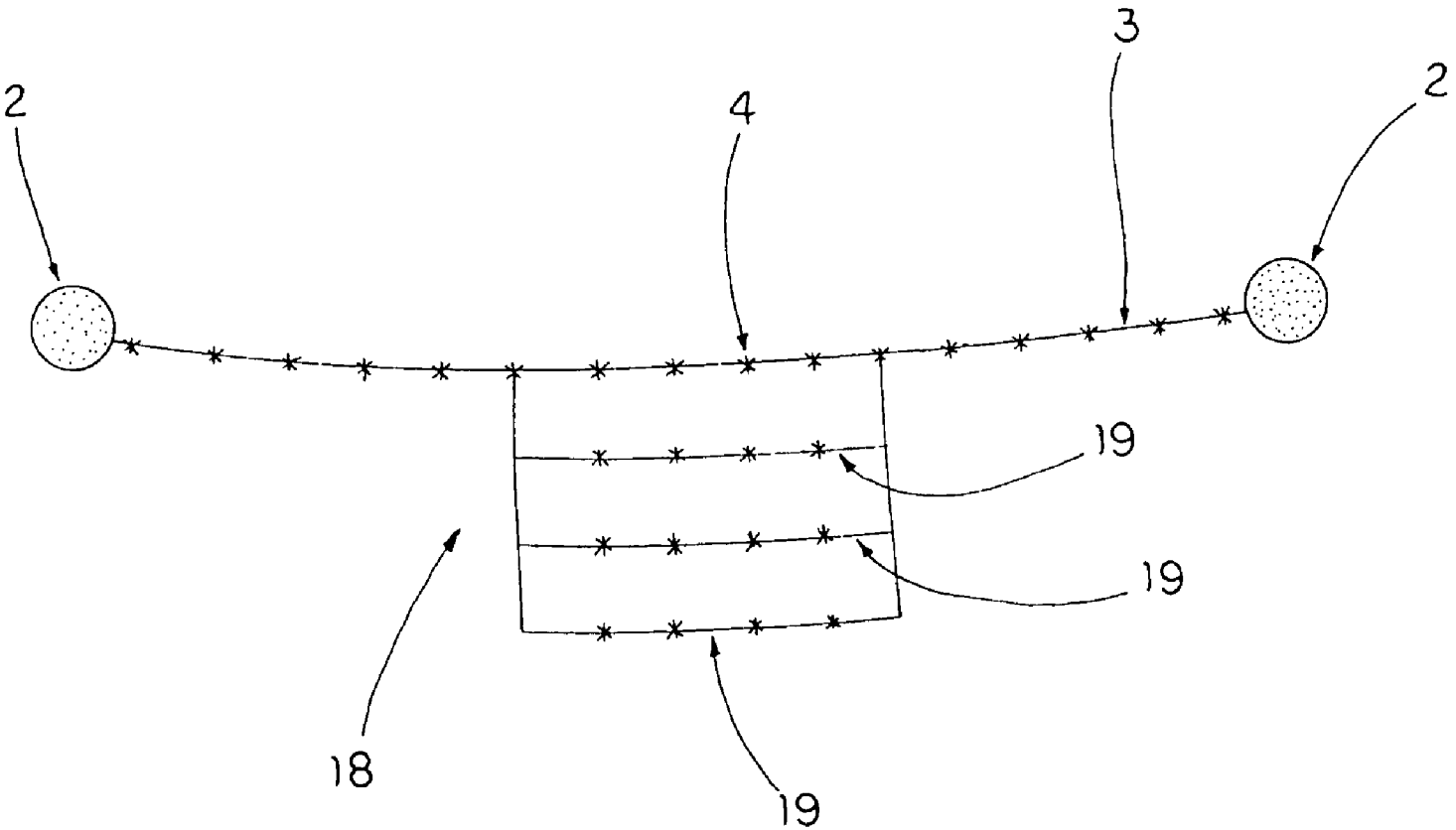
FIG. 14 is a top plan view of an entrapment snare wherein a cable ladder comprising multiple spike cables arranged in a rectangular mesh is attached to and trails behind the forward most spike cable.

FIG. 14 shows an entrapment snare wherein a cable ladder 18 comprising multiple spike cables 19 arranged in a rectangular mesh is attached to and trails behind the forward most spike cable 3. This arrangement will be drawn into, and wrap around the target tire like a snow chain. Various types of spikes or barbs 4 can then deflate the tire rapidly or slowly.

Figure 15:
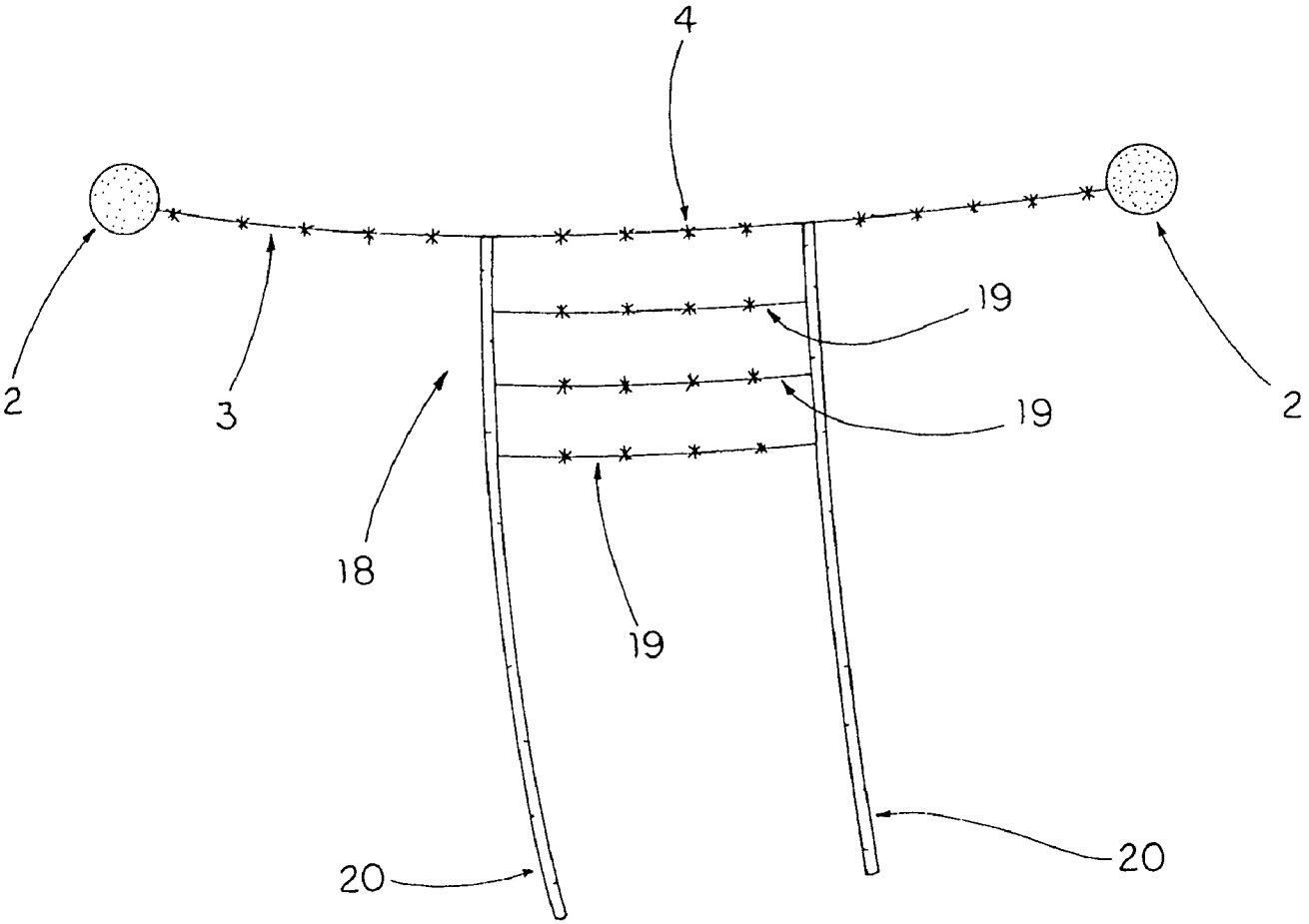
FIG. 15 is a top plan view of an entrapment snare according to the preferred embodiment of the present invention, wherein arresting cables are attached to the outermost edges of and trail behind the cable ladder.

FIG. 15 shows the entrapment snare arrangement of FIG. 14 wherein heavy arresting cables 20 are attached to the outermost edges of, and trail behind the cable ladder 18. Once the forward most spike cable 3 and the following mesh of spike cables (cable ladder) 18 have embedded themselves around the targeted tire 71 (shown in FIG. 2) like a snow chain, the arresting cables 20 will initially trail behind, on the left and right sides of the target tire 71. As the tire 71 rotates, (there would be two arresting cables 20 for projectile symmetry but also so that the mechanism can be shot at either the left or right rear tire 71 of the fleeing vehicle 70 shown in FIG. 2) one of the arresting cables 20 will wrap around the axle (not shown) of the vehicle 70. Thus, the vehicle 70 will be disabled because there will be a heavy cable 20 wrapped around the rear axle (not shown) linked to a mesh of spike cables 18 wrapped around the targeted tire 71. This method will stop a vehicle 70 from running along on flattened tires 71.

The entrapment snare 1 of FIG. 1 and the attach and attack mechanism 5 of FIG. 11 provide the means to enable a new method for disabling a fleeing vehicle by attacking the rear tire 71 (shown in FIG. 2) of a fleeing vehicle 70 with a flexible cable 3 or a flexible chain comprising rigid segments 6 and joints 7. Projectile weights 2 are attached to the ends of the flexible cable 3 or chain 6 & 7 and the assembly is flung at ground level at a fleeing vehicle's rear tire 71 such that the weights 2 bracket the tire 71. When the center of the cable 3 or chain 6 & 7 contacts the tire, the kinetic energy of the weights 2 will cause the cable 3 or chain 6 & 7 to wrap around the tire 71. If the tire is in forward motion, it will then drive over the parts of the cable 3 or chain 6 & 7 that cross around in front of it, driving over spikes or hooked barbs 4 (shown in FIG. 1) and disabling the vehicle 70.

The objectives of the invention can be achieved with a device such as the entrapment snare 1 of FIG. 1 or the attach and attack mechanism 5 of FIG. 11 wherein the projectile weights 2 are not present. The projectile weights 2 facilitate the ease with which such a device can be flung at a target tire. After contact, the kinetic energy of the weights will cause such a device to wrap around the targeted tire more rapidly than if such weights were not present. Nonetheless, if such a device does not have projectile weights but is flung at a target forcefully enough, it will still wrap around the target.

There are many different ways to make a flexible cable for use in the invention. Any device whose length is considerably larger than any other dimension (such as diameter, width or thickness) and which is flexible enough to completely wrap around an object smaller than its length could be used to meet the objectives of the invention.

According to the preferred embodiment of the present invention, the present invention also provides a method for deflating a rear tire 71 of a fleeing vehicle 70, wherein the method comprises the steps of:

(a) providing an entrapment snare 1 which comprises a flexible cable 3; and two projectile weights 2 each of which is attached to one of the ends of said flexible cable 3; and a plurality of spikes 4 disposed along said flexible cable 3;

(b) projecting said entrapment snare toward said rear tire 71 of said fleeing vehicle 70 such that one of said projectile weights 2 passes to the left side of said rear tire 71 and the other projectile weight 2 passes to the right side of said rear tire 71;

(c) contacting the rear side of said rear tire 71 with said flexible cable 3;

(d) wrapping said flexible cable 3 around said rear tire 71 by swinging said projectile weights 2 around the front side of said rear tire 71; and (e) deflating said rear tire 71 as said fleeing vehicle 70 rolls over said spikes 4 which puncture said rear tire 71 so as to stop said fleeing vehicle 70.

The invention has been described with reference to preferred embodiments but various modifications and variations would be obvious to one of ordinary skill in the art and the description of the preferred embodiments is not intended to be limiting. All modifications, variations and equivalent arrangements that are within the scope of the following claims should be considered to be within the scope of the invention.

What is claimed is:

1. A method for deflating a rear tire of a fleeing vehicle, comprising the steps of:

(a) providing an entrapment snare which comprises a flexible cable, two projectile weights each of which is attached to one of two ends of said flexible cable; and a plurality of spikes disposed along said flexible cable, said snare being loaded for being shot from a pursuing vehicle towards said fleeing vehicle;

(b) projecting said snare from said pursuing vehicle towards said rear tire of said fleeing vehicle such that one of said projectile weight passes to the left side of said rear tire and said remaining projectile weight passes to the right side of said rear tire;

(c) contacting the rear side of said rear tire with said flexible cable;

(d) wrapping said flexible cable around said rear tire by swinging said projectile weights around the front side of said rear tire; and (e) deflating said rear tire as said fleeing vehicle rolls over said spikes which puncture said rear tire so as to stop said fleeing vehicle.

* * * * *